US011315532B2

(12) United States Patent
Watanabe

(10) Patent No.: US 11,315,532 B2
(45) Date of Patent: Apr. 26, 2022

(54) CHORD INFORMATION EXTRACTION DEVICE, CHORD INFORMATION EXTRACTION METHOD AND NON-TRANSITORY COMPUTER READABLE MEDIUM STORING CHORD INFORMATION EXTRACTION PROGRAM

(71) Applicant: YAMAHA CORPORATION, Hamamatsu (JP)

(72) Inventor: Daichi Watanabe, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 177 days.

(21) Appl. No.: 16/804,845

(22) Filed: Feb. 28, 2020

(65) Prior Publication Data

US 2020/0202822 A1 Jun. 25, 2020

Related U.S. Application Data

(63) Continuation of application No. PCT/JP2017/032379, filed on Sep. 7, 2017.

(51) Int. Cl.
*G10G 3/04* (2006.01)
*G10H 1/00* (2006.01)

(52) U.S. Cl.
CPC ..... *G10G 3/04* (2013.01); *G10H 1/0008* (2013.01); *G10H 2210/066* (2013.01); *G10H 2210/086* (2013.01); *G10H 2210/571* (2013.01)

(58) Field of Classification Search
CPC .. G10G 3/04; G10H 1/0008; G10H 2210/066; G10H 2210/086; G10H 2210/571
USPC ..... 84/609
See application file for complete search history.

(56) References Cited

U.S. PATENT DOCUMENTS 4,944,022 A 7/1990 Yasujima
5,644,652 A 7/1997 Bellegarda
7,642,444 B2 * 1/2010 Fujishima ..... G10H 1/0025 84/618

(Continued)

FOREIGN PATENT DOCUMENTS

JP S5886695 U 6/1983
JP S63265377 A 11/1988

(Continued)

OTHER PUBLICATIONS

Office Action issued in Japanese Appln. No. 2019-540227 dated Dec. 22, 2020. English machine translation provided.

(Continued)

*Primary Examiner* — Christina M Schreiber
(74) *Attorney, Agent, or Firm* — Rossi, Kimms & McDowell LLP

(57) ABSTRACT

A chord information extraction device includes a character group extractor, a determiner and a corrector. The character group extractor extracts a character group corresponding to chord information from score image data representing a music score. The determiner determines whether the character group extracted by the character group extractor follows a predetermined chord notation rule. In a case where the character group extracted by the character group extractor does not follow the chord notation rule, the corrector corrects the extracted character group to follow the chord notation rule.

18 Claims, 9 Drawing Sheets

(56) References Cited

U.S. PATENT DOCUMENTS

| | | | | |
|---|---|---|---|---|
| 7,960,638 | B2 * | 6/2011 | Miyajima | G10H 1/0025 84/604 |
| 9,040,805 | B2 * | 5/2015 | Kobayashi | G10H 1/0025 84/616 |
| 9,536,508 | B2 * | 1/2017 | Okazaki | G10H 1/38 |
| 9,799,315 | B2 * | 10/2017 | Hardi | G10D 13/26 |
| 10,013,963 | B1 * | 7/2018 | Ka | G10H 1/0008 |
| 2006/0065100 | A1 * | 3/2006 | Funaki | G10H 1/0008 84/471 R |
| 2008/0115656 | A1 * | 5/2008 | Sumita | G10G 3/04 84/612 |
| 2015/0096433 | A1 * | 4/2015 | Watanabe | G10H 1/361 84/613 |
| 2016/0148606 | A1 * | 5/2016 | Minamitaka | G10H 1/38 84/609 |
| 2016/0210951 | A1 * | 7/2016 | Rutledge | G10H 1/38 |
| 2019/0051275 | A1 * | 2/2019 | Ka | G06F 16/634 |
| 2020/0202822 | A1 * | 6/2020 | Watanabe | G10H 1/0008 |
| 2020/0202823 | A1 * | 6/2020 | Watanabe | G06K 9/6271 |

FOREIGN PATENT DOCUMENTS

| | | | |
|---|---|---|---|
| JP | H07200742 | A | 8/1995 |
| JP | H1125229 | A | 1/1999 |
| JP | H11161738 | A | 6/1999 |
| JP | 2007122277 | A | 5/2007 |
| JP | 4702139 | B2 | 6/2011 |
| JP | 2015075575 | A | 4/2015 |

OTHER PUBLICATIONS

International Search Report issued in Intl. Appln. No. PCT/JP2017/032379 dated Nov. 21, 2017. English translation provided.

Written Opinion issued in Intl. Appln. No. PCT/JP2017/032379 dated Nov. 21, 2017.

* cited by examiner

REFERENCE SCORE

FIG. 6

CHORD ROOT CORRECTION TABLE

ATa

| INCORRECT | # | & | a | e | o | L |
|---|---|---|---|---|---|---|
| CORRECT | A | B | B | B | D | E |

FIG. 7

CHORD TYPE CORRECTION TABLE

ATb

| INCORRECT | N7 | m#7 | N7♭5 | a7 | A7 |
|---|---|---|---|---|---|
| CORRECT | M7 | maj7 | m7♭5 | Δ7 | Δ7 |

CHORD INFORMATION EXTRACTION DEVICE, CHORD INFORMATION EXTRACTION METHOD AND NON-TRANSITORY COMPUTER READABLE MEDIUM STORING CHORD INFORMATION EXTRACTION PROGRAM

BACKGROUND OF THE INVENTION

Field of the Invention

The present invention relates to a chord information extraction device, a chord information extraction method and a non-transitory computer readable medium storing a chord information extraction program for extracting chord information from image data of a music score.

Description of Related Art

Conventionally, it has been suggested that image data of a score is acquired using a scanner or the like, and various information related to a music piece is extracted from the image data. For example, an electronic musical instrument system constituted by an electronic musical instrument and an image capturing device is described in JP 4702139 B2. The image capturing device includes a scanner, a digital camera or the like, and reads music piece information from a music score printed on a sheet of paper (printed music score). The music piece information includes setting information such as registration associated with performance of a music piece in addition to general music score information. The read music piece information is converted into music score image information, and the music score image information is input to an electronic musical instrument. When acquiring the music score image information, the electronic musical instrument converts the music score image information into music piece data by a music score reading process using an image analysis technique to read the data.

BRIEF SUMMARY OF THE INVENTION

Chord information representing a chord in a music piece (a chord that is a combination of a chord root and a chord type, for example) may be notated on a score. In the above-mentioned electronic musical instrument system, a QR code (registered trademark), for example, is provided on a printed music score as setting information, and it is possible to acquire the setting information by reading the QR code (registered trademark). However, the chord information notated on a general score cannot be extracted accurately.

An object of the present invention is to provide a chord information extraction device, a chord information extraction method and a non-transitory computer readable medium storing a chord information extraction program for extracting chord information efficiently from score image data.

A chord information extraction device according to one aspect of the present invention includes a character group extractor configured to extract a character group corresponding to chord information from score image data representing a music score, a determiner configured to determine whether the extracted character group follows a predetermined chord notation rule, and a corrector configured to, in a case where the determiner determines that the extracted character group does not follow the chord notation rule, correct the extracted character group such that the extracted character group follows the chord notation rule.

In an embodiment, the chord notation rule may define a chord root rule in regard to a chord root and a chord type rule in regard to a chord type, and the determiner may be configured to determine that the extracted character group follows the chord notation rule, in a case where the extracted character group includes a chord root character group representing a chord root and a chord type character group representing a chord type, when the chord root character group follows the chord root rule, and the chord type character group follows the chord type rule. In an embodiment, the corrector may be configured to correct a character, which does not follow the chord notation rule, in the extracted character group based on a predetermined correction table.

In an embodiment, the chord information extraction device may further include a font information acquirer configured to acquire font information representing a font of a character group corresponding to the chord information, wherein the character group extractor may be configured to extract a character group corresponding to the chord information based on the acquired font information. In an embodiment, the chord information extraction device may further include a font receiver that is configured to receive designation of a font by a user, wherein the font information acquirer may be configured to acquire the font information representing the designated font. In an embodiment, the chord information extraction device may further include a font determiner configured to extract at least one character from the score image data and determine a font of the extracted character, wherein the font information acquirer may be configured to acquire the font information representing the determined font. In an embodiment, the chord information extraction device may further include a position information acquirer configured to acquire position information representing a position of the extracted character group in the music score, and a time position specifier configured to specify a time position in a music piece represented by the music score based on the acquired position information.

A chord information extraction method according to another aspect of the present invention includes extracting a character group corresponding to chord information from score image data representing a music score, determining whether the extracted character group follows a predetermined chord notation rule, and correcting, in a case where it is determined that the extracted character group does not follow the chord notation rule, the extracted character group such that the extracted character group follows the chord notation rule.

In an embodiment, the chord notation rule may define a chord root rule in regard to a chord root and a chord type rule in regard to a chord type, and the determining may include determining that the extracted character group follows the chord notation rule, in a case where the extracted character group includes a chord root character group representing a chord root and a chord type character group representing a chord type, when the chord root character group follows the chord root rule, and the chord type character group follows the chord type rule. In an embodiment, the correcting may include correcting a character, which does not follow the chord notation rule, in the extracted character group based on a predetermined correction table.

In an embodiment, the chord information extraction method may further include acquiring font information representing a font of a character group corresponding to the chord information, wherein the extracting a character group may include extracting a character group corresponding to the chord information based on the acquired font information. In an embodiment, the chord information extraction method may further include receiving designation of a font by a user, wherein the acquiring the font information may include acquiring the font information representing the designated font. In an embodiment, the chord information extraction method may further include extracting at least one character from the score image data, and determining a font of the extracted character, wherein the acquiring the font information may include acquiring the font information representing the determined font. In an embodiment, the chord information extraction method may further include acquiring position information representing a position of the extracted character group in the music score; and specifying a time position in a music piece represented by the music score based on the acquired position information.

A non-transitory computer readable medium according to yet another aspect of the present invention stores a chord information extraction program, wherein the chord information extraction program causes a computer to extract a character group corresponding to chord information from score image data representing a music score, determine whether the extracted character group follows a predetermined chord notation rule, and correct, in a case where it is determined that the extracted character group does not follow the chord notation rule, the extracted character group such that the extracted character group follows the chord notation rule.

Other features, elements, characteristics, and advantages of the present invention will become more apparent from the following description of preferred embodiments of the present invention with reference to the attached drawings.

BRIEF DESCRIPTION OF THE SEVERAL VIEWS OF THE DRAWING

FIG. 6 is a diagram showing one example of a chord root correction table;

FIG. 7 is a diagram showing one example of a chord type correction table;

DESCRIPTION OF THE PREFERRED EMBODIMENTS

A chord information extraction device, a chord information extraction method and a non-transitory computer readable medium storing a chord information extraction program according to embodiments of the present invention will be described below in detail with reference to the drawings.

[1] Configuration of Chord Information Extraction Device

Figure 1:
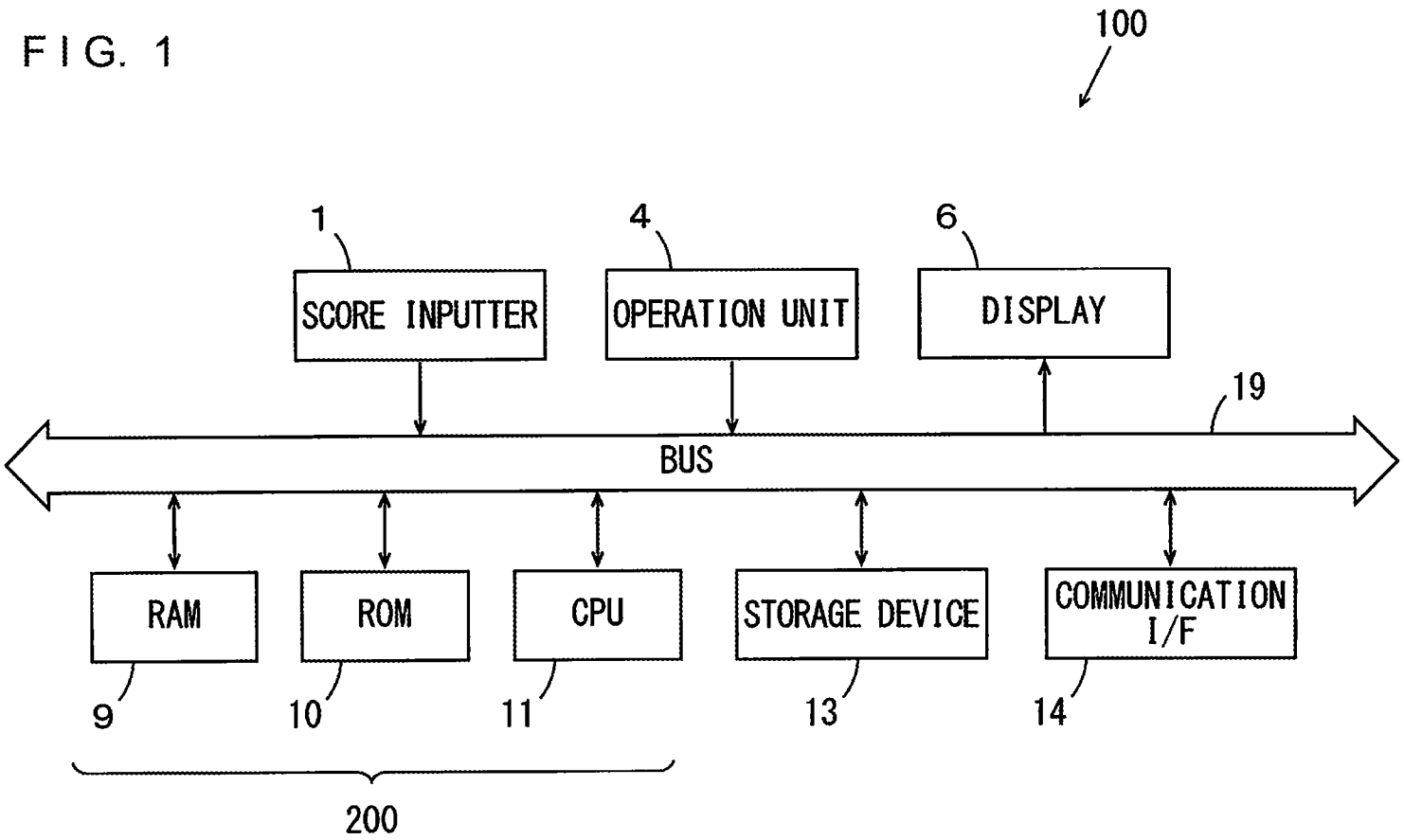
FIG. 1 is a block diagram showing the configuration of a chord information extraction device according to an embodiment of the present invention.

FIG. 1 is a block diagram showing the configuration of the chord information extraction device according to an embodiment of the present invention. The chord information extraction device 100 of FIG. 1 extracts chord information representing a chord from score image data representing a music score.

The chord information extraction device 100 of FIG. 1 includes a score inputter 1, an operation unit 4, a display 6, a RAM (Random Access Memory) 9, a ROM (Read Only Memory) 10, a CPU (Central Processing Unit) 11, a storage device 13 and a communication I/F (interface) 14. These constituent elements are connected to a bus 19 respectively.

The score inputter 1 reads a music score printed on a recording medium such as a sheet of paper, and inputs the score image data representing the music score to the CPU 11. For example, the score inputter 1 is a scanner and includes a light source and an optoelectronic transducer. The music score is irradiated with light from the light source, and the reflected light is received by the optoelectronic transducer. The optoelectronic transducer generates score image data based on the received light.

The operation unit 4 includes various operating elements to be operated by a user, and is used for on-off of a power supply and various settings. The display 6 includes a liquid crystal display, for example, and displays the extracted chord information. At least part of the operation unit 4 and the display 6 may be constituted by a touch panel display.

The RAM 9, the ROM 10 and the CPU 11 constitute a computer 200. The RAM 9 is a volatile memory, for example, which is used as a working area for the CPU 11, and temporarily stores various data. The ROM 10 is a non-volatile memory, for example, and stores computer programs such as a control program and the chord information extraction program. The CPU 11 executes the chord information extraction program stored in the ROM 10 on the RAM 9 to perform a chord information extraction process mentioned below.

The storage device 13 includes a storage medium such as a hard disc, an optical disc, a magnetic disc or a memory card. The storage device 13 stores a chord notation rule and a correction table. The chord notation rule defines a rule for chord notation. The correction table is used to correct a character group extracted from the score image data. Details of the chord notation rule and the correction table will be described below. One or a plurality of score image data pieces may be stored in the storage device 13, or the chord information extraction program may be stored in the storage device 13.

The communication I/F 14 can be connected to various external equipment such as an external storage device. Further, the communication I/F 14 may be connected to a communication network. In a case where the communication I/F 14 is connected to an external storage device, at least one of the chord information extraction program, the score image data, the chord notation rule and the correction table may be stored in the external storage device.

The chord information extraction program in the present embodiment may be supplied in the form of being stored in a storing media which is readable by a computer, and installed in the ROM 10 or the storage device 13. In addition, in a case where the communication I/F 14 is connected to a communication network, the chord information extraction program delivered from a server connected to the communication network may be installed in the ROM 10 or the storage device 13. Similarly, at least one of the score image data, the chord notation rule and the correction table may be acquired from the storage medium or may be acquired from the server connected to the communication network.

[2] Functional Configuration of Chord Information Extraction Device

Figure 2:
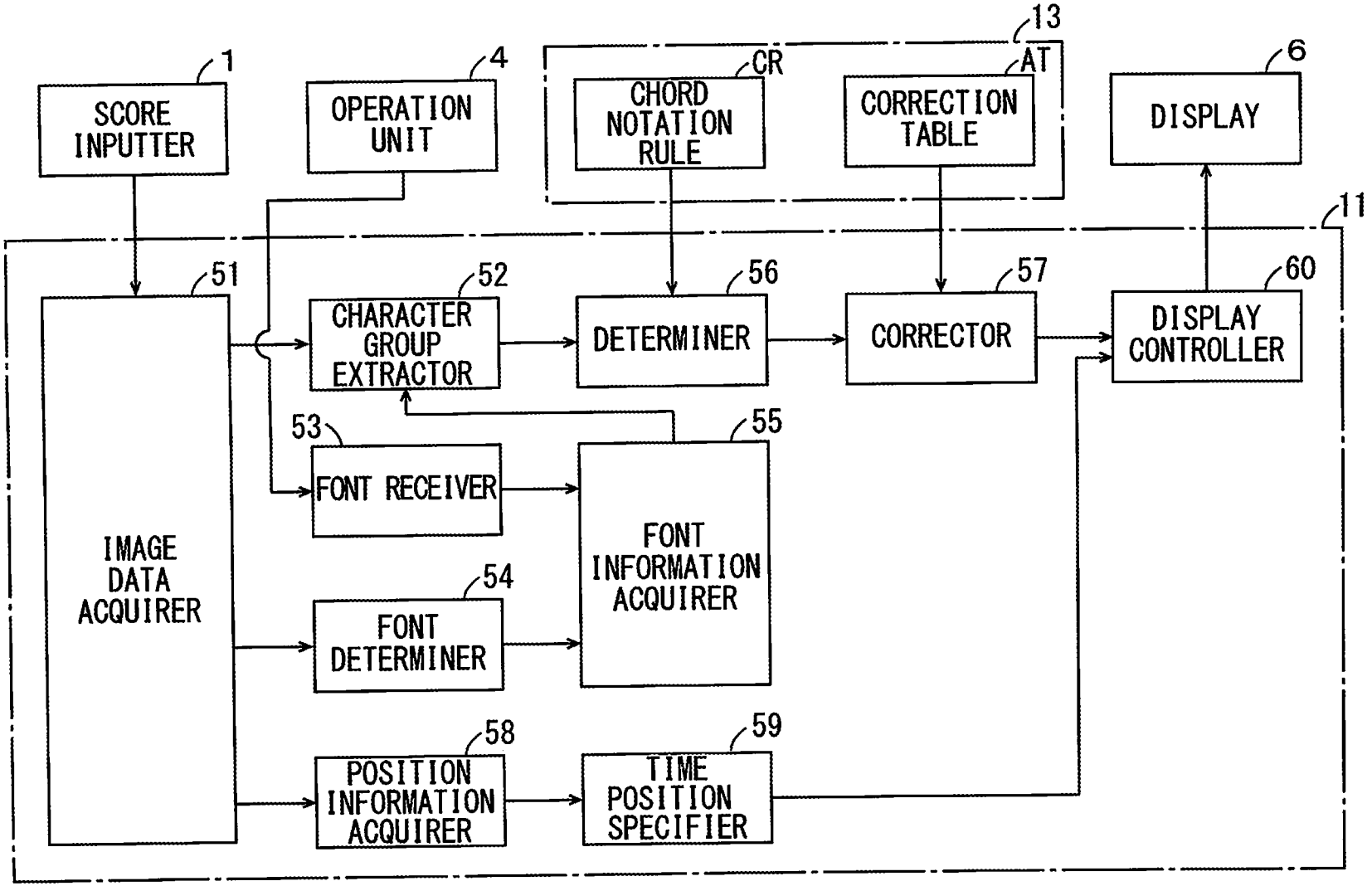
FIG. 2 is a block diagram showing the functional configuration of the chord information extraction device.

FIG. 2 is a block diagram showing the functional configuration of the chord information extraction device 100. As shown in FIG. 2, the chord information extraction device 100 includes an image data acquirer 51, a character group extractor 52, a font receiver 53, a font determiner 54, a font information acquirer 55, a determiner 56, a corrector 57, a position information acquirer 58, a time position specifier 59 and a display controller 60. The CPU 11 of FIG. 1 executes the chord information extraction program to realize the functions of these constituent elements.

The image data acquirer 51 acquires the score image data input by the score inputter 1. The image data acquirer 51 may acquire the score image data from any of the storage device 13 of FIG. 1, the external storage device connected to the communication I/F 14 and the server connected to the communication network. Hereinafter, the score represented by the acquired score image data is referred to as a reference score. Further, a music piece corresponding to the reference score (a music piece played according to the reference score) is referred to as a reference music piece.

The character group extractor 52 extracts one or a plurality of character groups (hereinafter referred to as chord character groups) corresponding to the chord information from the acquired score image data. The chord character group includes one or a plurality of characters representing chord names. Specifically, the character group extractor 52 extracts the image data of the chord character group from the score image data, and recognizes each of the characters (hereinafter referred to as chord characters) included in the chord character group based on the extracted image data. The chord characters includes numerals, alphabets, music symbols such as "#" (sharp) and "♭" (flat), and symbols used for chord notation such as "Δ" (major) and "φ"(half diminished).

The font receiver 53 receives the designation of a font (hereinafter referred to as a chord font) of the chord character group by the user. The chord font differs depending on a score. As such, the user designates a chord font by operating the operation unit 4, for example. The font determiner 54 extracts at least one character from the acquired score image data as a reference character, and determines the font of the extracted reference character as the chord font. In this case, the extracted chord character group may be used as a reference character. For example, in a case where the chord font is not received by the font receiver 53 (in a case where the user does not designate the chord font), the font determiner 54 determines the chord font.

The font information acquirer 55 acquires the font information representing the chord font. In the present example, the font information acquirer 55 acquires the font information representing the chord font received by the font receiver 53 or the chord font determined by the font determiner 54. Further, in the present example, the character group extractor 52 recognizes each chord character included in the extracted chord character group based on the acquired font information.

The determiner 56 determines whether the extracted chord character group follows the chord notation rule CR stored in the storage device 13 of FIG. 1. Hereinafter, the determination made by the determiner 56 is referred to as chord correctness determination. The chord correctness determination may be carried out based on a table prepared in advance, or may be carried out based on a predetermined algorithm. A specific example of chord correctness determination will be described below. In a case where the extracted chord character group does not follow the chord notation rule CR, the extracted chord character group is corrected by the corrector 57 to follow the chord notation rule CR. In the present example, the corrector 57 corrects a chord character, which does not follow the chord notation rule CR, in the extracted chord character group based on a correction table AT stored in the storage device 13. The corrector 57 may correct the chord character group based on the predetermined algorithm instead of using the correction table AT. The corrected chord character group is extracted as the chord information.

The position information acquirer 58 acquires the position information representing the position of the chord character group on the reference score. The position information represents the coordinates of each chord character group on the reference score, for example. The time position specifier 59 specifies the time position of each chord information in the reference music piece based on the acquired position information. The time position is represented by a measure number, a beat and a tick, for example.

The display controller 60 controls the display 6 such that the chord information represented by the corrected chord character group is displayed. For example, the display controller 60 displays the chord score of the reference music piece on the screen of the display 6 based on the corrected chord character group and the time position specified by the time position specifier 59.

[3] Extraction of Chord Information

Figure 3:
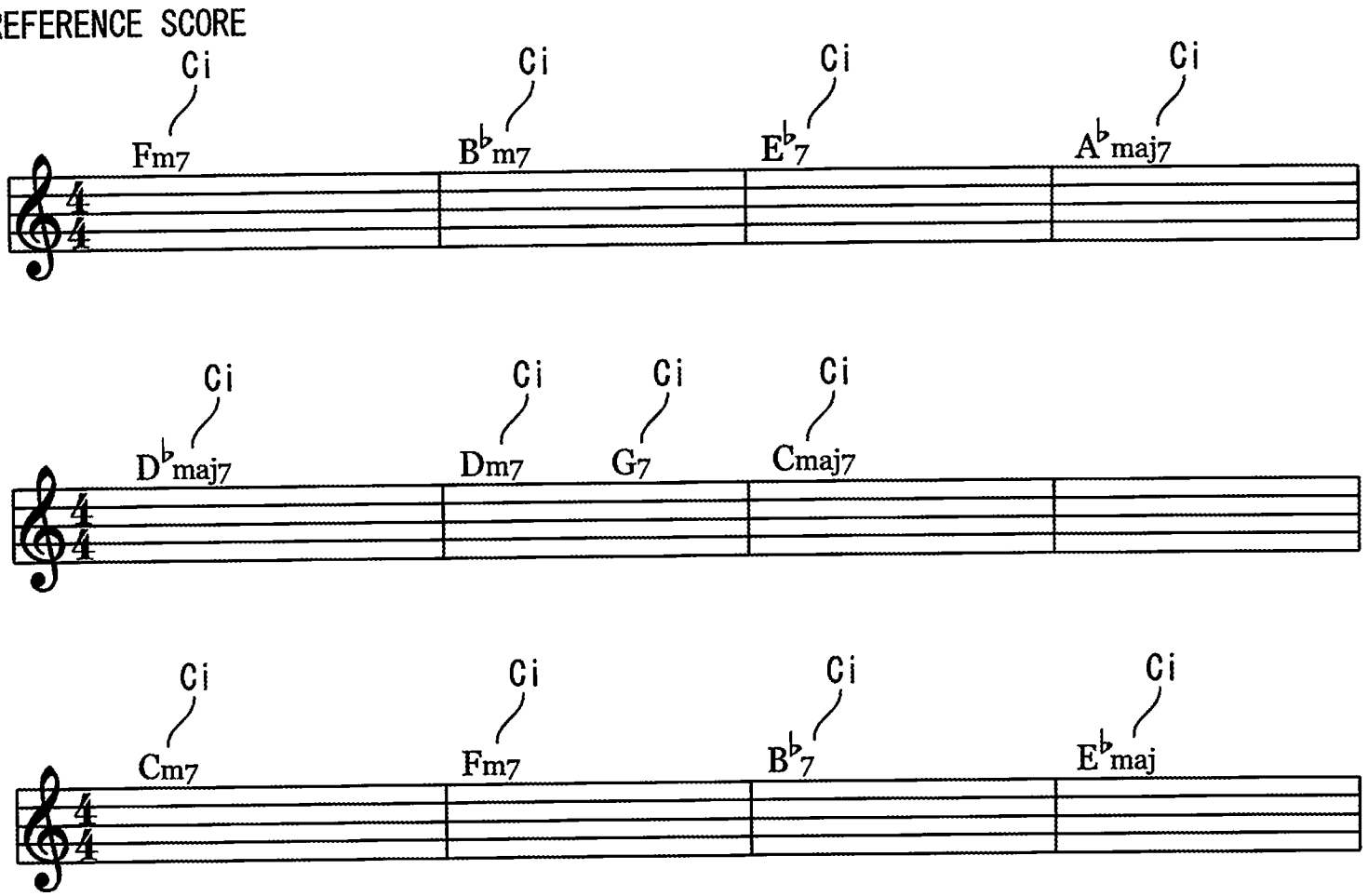
FIG. 3 is a diagram showing one example of the reference score represented by the score image data.

One example of extraction of the chord information from the score image data will be described. FIG. 3 is a diagram showing one example of the reference score represented by the score image data. The reference score of FIG. 3 is represented by staff notation and includes a plurality of five-line staves and a plurality of chord information pieces Ci. Notes on staves are not shown. The plurality of chord information pieces Ci are written using chord names such as "$Fm_7$", "$B^{\flat}m_7$" and "$E^{\flat}{}_7$" in the region above each five-line staff.

Image data of a chord character group is extracted from the score image data representing such a reference score by the character group extractor 52 of FIG. 2. For example, the region in which the chord information is notated on the reference score (the region above each five-line staff in the example of FIG. 3) is specified in advance, and the image data of a chord character group is extracted based on the luminance distribution of the specified region.

Subsequently, each chord character is recognized by the character group extractor 52 based on the image data of the extracted chord character group. In the present example, each chord character is recognized based on the font information acquired in advance by the font information acquirer 55 of FIG. 2.

Figure 4:
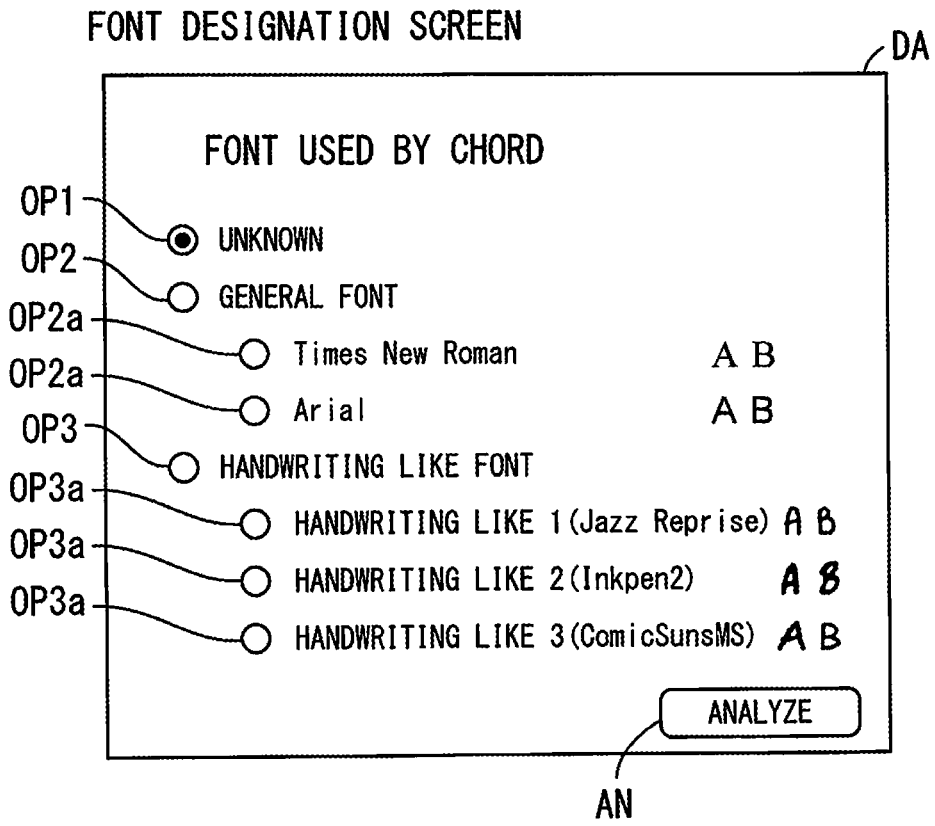
FIG. 4 is a diagram showing an example of a font designation screen.

For example, the display 6 of FIG. 1 displays a font designation screen, and the user designates a chord font in the font designation screen. FIG. 4 is a diagram showing an example of the font designation screen. The font designation screen DA of FIG. 4 includes option buttons OP1, OP2, OP3, a plurality of option buttons OP2*a*, a plurality of option buttons OP3*a* and an analysis button AN.

In a case where the chord font is unknown, the user turns on the option button OP1. In a case where the chord font is a general font, the user turns on the option button OP2 and turns on the option button OP2*a* corresponding to the chord font among the plurality of option buttons OP2*a* respectively corresponding to a plurality of general fonts. In a case where the chord font is a handwriting like font, the user turns on the option button OP3 and turns on the option button OP3*a* corresponding to the chord font among the plurality of option buttons OP3*a* respectively corresponding to a plurality of handwriting like fonts.

When any of the option buttons OP2*a* or any of the option buttons OP3*a* is turned on, the chord font is designated. In a case where the analysis button AN is turned on in that state, the designation of the chord font is received by the font receiver 53 of FIG. 2, and the chord character is recognized based on the designated chord font. On the other hand, in a case where the analysis button AN is turned on with the option button OP1 turned on, the chord font is automatically determined by the font determiner 54 of FIG. 2, and the chord character is recognized based on the determined chord font. A known technique such as a convolutional neural network is used in order to recognize the chord character.

In a case where the chord font is apparent, the user designates the chord font. Thus, each chord character is accurately recognized. On the other hand, even in a case where the chord font is unknown, the chord font is automatically determined based on a reference character. Thus, degradation of recognition accuracy of each chord character is suppressed.

Figure 5:
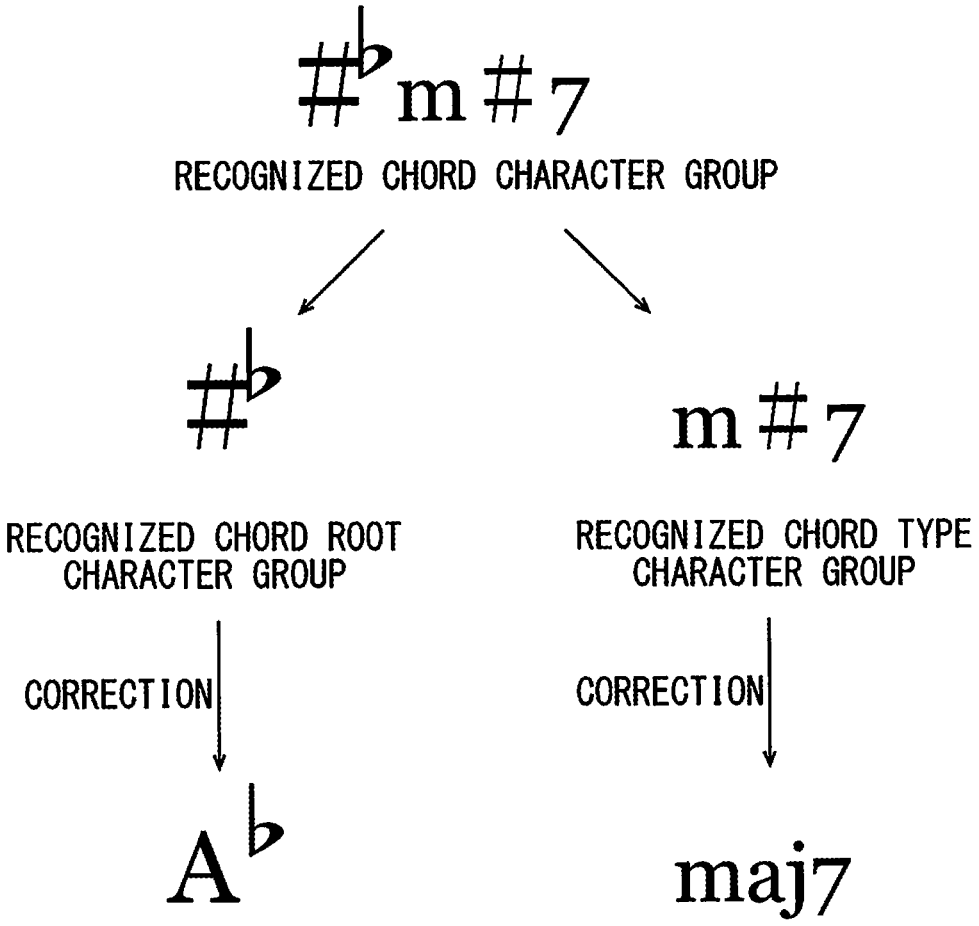
FIG. 5 is a diagram for explaining one example of chord correctness determination.

The chord character group in which each chord character has been recognized in this manner is referred to as a recognized chord character group. The chord correctness determination is carried out by the determiner 56 of FIG. 2 in regard to the recognized chord character group. FIG. 5 is a diagram for explaining one example of the chord correctness determination. In the example of FIG. 5, the recognized chord character group is "$\#^{\#}$m $\#_7$."

Normally, a chord name is represented by one or a plurality of characters representing chord roots (hereinafter referred to as a chord root character group) and one or a plurality of characters representing chord types (hereinafter referred to as a chord type character group). For example, in regard to the chord name "$A^{\flat}maj_7$," the chord root character group is "$A^{\flat}$" and the chord type character group is "$maj_7$." Normally, the chord root character group is notated before the chord type character group. However, a major triad chord or the like may be notated with only a chord root character group. For example, a C major triad may be notated with one character "C." In this case, a chord type character group is not notated.

The chord root character group includes only one of the seven alphabets "A" to "G" representing the names of musical note or two characters including the one alphabet, and "#" or "♭" following the one alphabet.

The chord type character group includes various numerals, alphabets and symbols. A chord type character group including one character is "$_7$" (seventh), "m" (a minor triad) or the like, a chord type character group including two characters is "$M_7$" (a major seventh), "$m_7$" (a minor seventh) or the like and a chord type character group including three or more characters is "dim" (diminished), "$maj_7$" (a major seventh) or the like. Even in a case where chord type character groups represent the same chord type, different chord type character groups may be notated. For example, "$maj_7$," "$Maj_7$," "$M_7$" and "$\Delta_7$" all represent a major seventh.

In the present example, the recognized chord character group is divided into a chord root character group and a chord type character group. Hereinafter, the chord root character group and the chord type character group included in the recognized chord character group are referred to as a recognized chord root character group and a recognized chord type character group, respectively.

For example, it is determined whether the second character of the recognized chord character group is "#" or "♭." In a case where the second character is "#" or "♭," the first character and the second character of the recognized chord character group are specified as the characters belonging to the recognized chord root character group, and the third character and a plurality of subsequent characters are specified as the characters belonging to the recognized chord type character group. In a case where the second character is neither "#" nor "♭," the first character of the recognized chord character group is specified as the character belonging to the recognized chord root character group, and the second character or a plurality of subsequent characters are specified as the characters belonging to the recognized chord type character group.

In the example of FIG. 5, because the second character of the recognized chord character group "$\#^{\#}$m $\#_7$" is "♭," the recognized chord root character group is "$\#^{\#}$" which includes the first and second characters of the recognized chord character group. Further, the recognized chord type character group is "m $\#_7$," which includes the characters following the recognized chord root character group.

A character group not corresponding to the chord information may be erroneously extracted from the score image data. Such a character group is preferably removed from the character groups subject to the chord correctness determination. For example, a character group including only numerals such as measure numbers or a rehearsal mark may be erroneously extracted as a chord character group. Since being clearly different from a chord character group, a character group including only numerals is preferably removed in advance. Further, a rehearsal mark normally includes a rectangular or circular frame, and a numeral or alphabet arranged within the frame. Therefore, such a character group including a character arranged within a frame may be determined as a rehearsal mark and may be removed in advance. Alternatively, in a case where the ratio of the characters that cannot be used for the chord notation to the plurality of characters included in the extracted character group is higher than a predetermined value, the character group may be removed in advance.

In the present example, the chord notation rule CR defines a chord root rule in regard to a chord root and a chord type rule in regard to a chord type. In a case where the recognized chord root character group follows the chord root rule, and the recognized chord type character group follows the chord type rule, it is determined that the recognized chord character group follows the chord notation rule CR. However, in a case where the recognized chord character group includes only a chord root character group (in a case where a chord type character group is not included), when the recognized chord root character group follows the chord root rule, it may be determined that the recognized chord character group follows the chord notation rule CR.

The chord root rule defines that the first character of the chord root character group is any of the alphabets "A" to "G," for example. In the example of FIG. 5, the first character of "#♭" is not any of "A" to "G." Therefore, it is determined that the recognized chord root character group does not follow the chord root rule.

The chord type rule defines the list of correct chord type character groups, for example. In a case where the recognized chord type character group matches any of the chord type character groups included in the list, it is determined that the recognized chord type character group follows the chord type rule. In the example of FIG. 5, "m $\#_7$" does not match any of the chord type character groups. Therefore, it is determined that the recognized chord type character group does not follow the chord type rule.

The chord type rule may define characters or combinations of characters that cannot be included in the correct chord type character groups. For example, "B," "C" and the like cannot be included in the correct chord type character groups. Although "#," "a," "7" or the like alone can be included in the chord type character groups, combinations of characters such as "#7," "#a," or "a7" cannot be included in the chord type character groups. In a case where such a character or such a combination of characters that cannot be included in the correct chord type character groups is included in the recognized chord type character group, it is determined that the recognized chord type character group does not follow the chord type rule.

Further, in a case where a combination of characters that cannot be included in the correct chord type character groups is included in the recognized chord character group, when each of those characters alone can be included in the correct chord type character group, an incorrect character (a character that does not follow the chord notation rule) may be specified as described below. For example, in a case where it is assumed that "7" is incorrect in regard to the combination of characters "d7," "dim" is a character group that starts with "d" and can be included in the chord type character group. However, "dim" is not a correction candidate for "d7" because the number of characters does not match that of "d7." On the other hand, in a case where it is assumed that "d" is incorrect, "M7," "Δ7," "m7" and "−7" are the character groups that end with "7" and can be included in the chord type character groups. Since the number of characters in these character groups matches that of "d7," they are correction candidates for "d7." Therefore, it is determined that "d" is an incorrect character.

In a case where not following the chord notation rule CR, the recognized chord character group is corrected by the corrector 57 of FIG. 2 to follow the chord notation rule CR. In the present example, the chord character that does not follow the chord notation rule CR is corrected based on the correction table AT. The correction table AT represents the correspondence relationship between the chord characters that do not follow the chord notation rule and the correct chord characters. In the present example, the correction table AT includes a chord root correction table for correcting recognized chord root character groups and a chord type correction table for correcting recognized chord type character groups. FIG. 6 is a diagram showing one example of the chord root correction table, and FIG. 7 is a diagram showing one example of the chord type correction table.

The chord root correction table ATa of FIG. 6 defines the correspondence relationship between the chord characters that do not follow the chord root rule (the upper row of FIG. 6) and the correct chord characters (the lower row of FIG. 6). For example, in a case where a chord character not following the chord root rule in the recognized chord root character group is "#," "#" is corrected to "A." Further, in a case where a chord character not following the chord root rule is "&," "&" is corrected to "B." In the example of FIG. 5, "#" not following the chord root rule in the recognized chord root character group "#b" is corrected to "A."

The chord type correction table ATb of FIG. 7 defines the correspondence relationship between chord characters or combinations of the chord characters (the upper row of FIG. 7) that do not follow the chord type rule, and the correct chord characters or combinations of the correct chord characters (the lower row of FIG. 7). For example, in a case where the combination of chord characters that does not follow the chord type rule is "$N_7$," "$N_7$" is corrected to "$M_7$." Further, in a case where the combination of chord characters that does not follow the chord type rule is "m $\#_7$," "m $\#_7$" is corrected to "$maj_7$." In the example of FIG. 5, the recognized chord type character group "m $\#_7$" is corrected to "$maj_7$."

The chord root correction table ATa and the chord type correction table ATb are generated based on a result of erroneous recognition in the past, a result of simulation and so on. For example, it has been found empirically or by simulation that "A" may be erroneously recognized as "#" in regard to the chord root character groups. Therefore, it is defined in the chord root correction table ATa that "#" is to be corrected to "A." A plurality of chord characters may be defined as correction candidates for one chord character that does not follow the chord notation rule. In that case, one chord character among the plurality of candidates is selectively used such that the chord character group follows the chord notation rule CR after the correction.

It is preferable that the chord root correction table ATa and the chord type correction table ATb are suitably updated. For example, in a case where a recognized chord character is not defined in the chord root correction table ATa or the chord type correction table ATb, the chord character and its corresponding correct chord character may be added to the chord root correction table ATa or the chord type correction table ATb. Alternatively, in a case where the result of correction with use of the chord root correction table ATa or the chord type correction table ATb is not appropriate, the chord root correction table ATa or the chord type correction table ATb may be revised based on the result.

When each chord character is recognized, a plurality of characters that are correction candidates may be acquired in regard to each chord character. In a case where a recognized chord character group includes a chord character that does not follow the chord notation rule CR, the recognized chord character group may be corrected with use of a character that follows the chord notation rule CR and is highly similar to the chord character to be corrected among the plurality of acquired characters.

In a case where a recognized chord character group includes "/" (slash), it may be determined that the recognized chord character group represents a slash chord. In this case, the recognized chord character group is divided into a numerator chord character group including one or a plurality of characters that are notated before "I" and a denominator chord character group including one or a plurality of characters that are notated after "/." Further, the chord correctness determination and correction may be carried out similarly to the description above in regard to each of the numerator character group and the denominator character group.

In regard to each extracted chord character group, the position information is acquired by the position information acquirer 58 of FIG. 2, and the time position in a reference music piece is specified by the time position specifier 59 of FIG. 2 based on the acquired position information.

Figure 8:
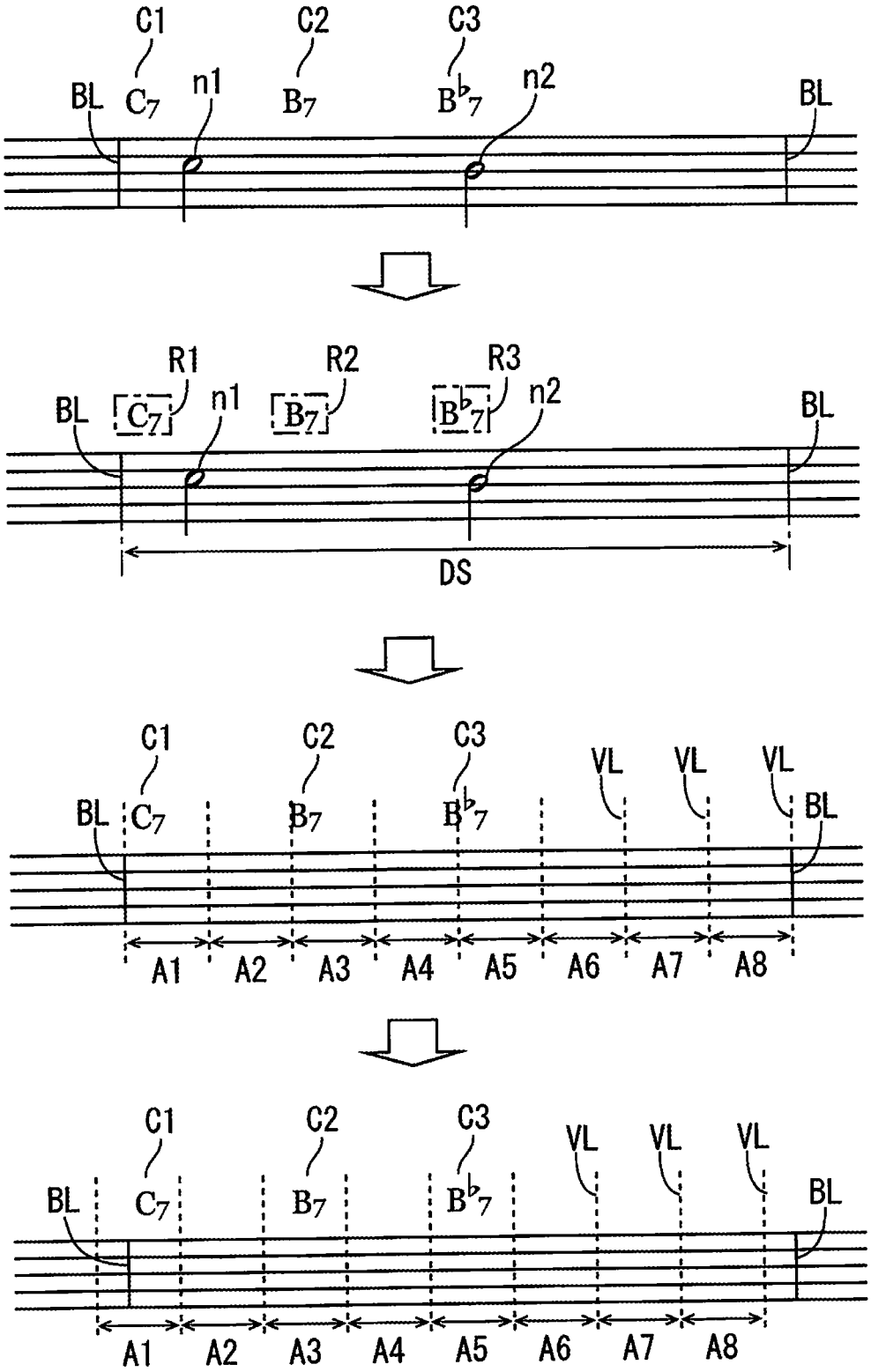
FIG. 8 is a diagram for explaining an example of acquisition of position information.

FIG. 8 is a diagram for explaining one example of acquisition of position information and specification of a time position. In the present example, a start position of each chord information piece is specified as a time position of each chord information piece. Further, the position information is acquired, and the time position is specified, for each measure. In the example of FIG. 8, each of three chord character groups C1, C2, C3 is shown in each region above a subject measure in a reference score. A time signature of a subject measure is 4/4.

The position information is represented by the coordinate in a direction representing the progress of a music piece, for example. In the example of FIG. 8, the direction representing the progress of the music piece is a transverse direction in parallel with a five-line staff. As such, the abscissas (X coordinates) of the chord character groups C1 to C3 in the reference score are acquired as the position information of the chord character groups C1 to C3. For example, rectangular regions R1, R2, R3 respectively including the chord character groups C1 to C3 are set as shown in the second field from the top in FIG. 8. In regard to each of the regions R1, R2, R3, the abscissa of the left end and the abscissa of the right end are acquired as the position information.

Subsequently, a corresponding note is searched in regard to the chord character groups C1 to C3. For example, notes in a subject measure are detected, and the abscissa of each detected note is acquired. Further, the abscissa of each chord character group is compared with the abscissa of each note, and a note having the closest abscissa is specified in regard to each chord character group. In a case where the difference between the abscissa of each chord character group and the abscissa of the specified note is equal to or smaller than a predetermined threshold value, it is determined that the specified note corresponds to the chord character group. On the other hand, in a case where the difference between the abscissa of each chord character group and the abscissa of the specified note is larger than the threshold value, it is determined that there is no note corresponding to the chord character group.

In the example of FIG. 8, among notes n1, n2 arranged in the subject measure, the note having the abscissa closest to the chord character group C1 is n1, and the note having the abscissa closest to the chord character group C3 is n2. Further, the difference between the abscissa of the chord character group C1 and the abscissa of the note n1, and the difference between the abscissa of the chord character group C3 and the abscissa of the note n2 are both equal to or smaller than the threshold value. Therefore, it is determined that the notes n1, n2 correspond to the chord character groups C1, C3, respectively. In this case, it is determined that the start position of the chord information corresponding to the chord character group C1 is the start position of the note n1 (a first beat), and the start position of the chord information corresponding to the chord character group C3 is the start position of the note n2 (a third beat).

Meanwhile, the note having the abscissa closest to the chord character group C2 is n1. However, the difference between the abscissa of the chord character group C2 and the abscissa of the note n1 is larger than the threshold value. Therefore, it is determined that there is no note corresponding to the chord character group C2.

In a case where there is no note corresponding to any of the chord character groups, the time position is specified based on the positional relationship between the chord character group and a barline. Specifically, left and right barlines BL respectively corresponding to the start position and the end position of the subject measure are detected, and the position information of the two barlines BL is acquired. For example, the abscissa of each barline BL is acquired as the position information. The distance DS between the two detected barlines in the transverse direction corresponds to the length of one measure.

Then, as shown in the third field from the top in FIG. 8, a plurality of virtual lines VL that divide the section between the two barlines BL equally into N segments in the transverse direction are set. N is a positive integer and corresponds to the quantization accuracy. N is 8 in the example of FIG. 8. Therefore, the subject measure is divided into eight unit segments A1 to A8. The length of one unit segment is equal to the length of an eighth note.

Subsequently, it is determined which one of the unit segments A1 to A8 the chord character group C2 having no corresponding note corresponds to. For example, the plurality of virtual lines VL are moved in a leftward direction such that the chord character group C2 does not overlap with any of the virtual lines VL. The distance by which the plurality of virtual lines VL are moved is a half or less than a half of the length (DS/N) of one unit segment, for example. As a result, as shown in the fourth field from the top in FIG. 8, the chord character group C2 is positioned between the two virtual lines VL representing the unit segment A3. In this case, it is determined that the chord character group C2 corresponds to the unit segment A3. Thus, it is determined that the start position of the chord information corresponding to the chord character group C2 is the start position of the unit segment A3 (second beat) in the subject measure.

Figure 9:
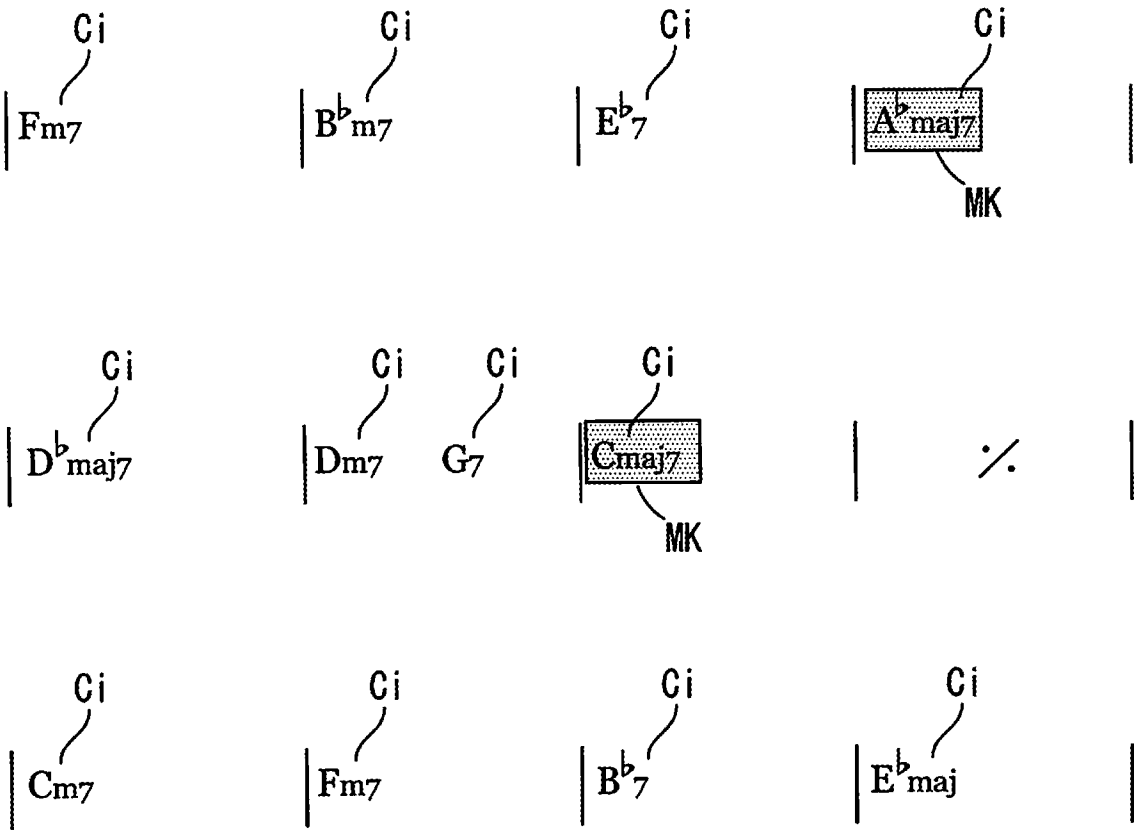
FIG. 9 is a diagram for explaining an example of display of chord information.

The chord information extracted in this manner is displayed on the screen of the display 6 by the display controller 60 of FIG. 2. FIG. 9 is a diagram for explaining a display example of the chord information. The example of FIG. 9 is a chord score corresponding to the reference score of FIG. 3, and includes a plurality of chord information pieces Ci notated on the reference score of FIG. 3. In this case, each chord information piece Ci is arranged based on the acquired time position.

The corrected chord character group may be displayed in a manner different from the uncorrected chord character group such that the user can distinguish the corrected chord character group from the uncorrected chord character group. In the example of FIG. 9, a marking MK with a specific color is applied to "$A^{\flat}maj_7$" (the fourth measure in the top row) and "$Cmaj_7$" (the third measure in the middle row), which are the corrected chord character groups. Further, the notation format of each chord information piece Ci may be arbitrarily changeable. For example, "$B^{\flat}m_7$" may be changed to "$B^{\flat}{}_{-7}$," and "$A^{\flat}maj_7$" may be changed to "$A^{\flat}{}_{\Delta 7}$."

The information relating to all notes and barlines may be extracted from the score image data. Similarly, various other information such as repeat barlines and repeat symbols may be extracted from the score image data. In this case, the chord information can be displayed in various forms such as staff notation.

[4] Chord Information Extraction Process

Figure 10:
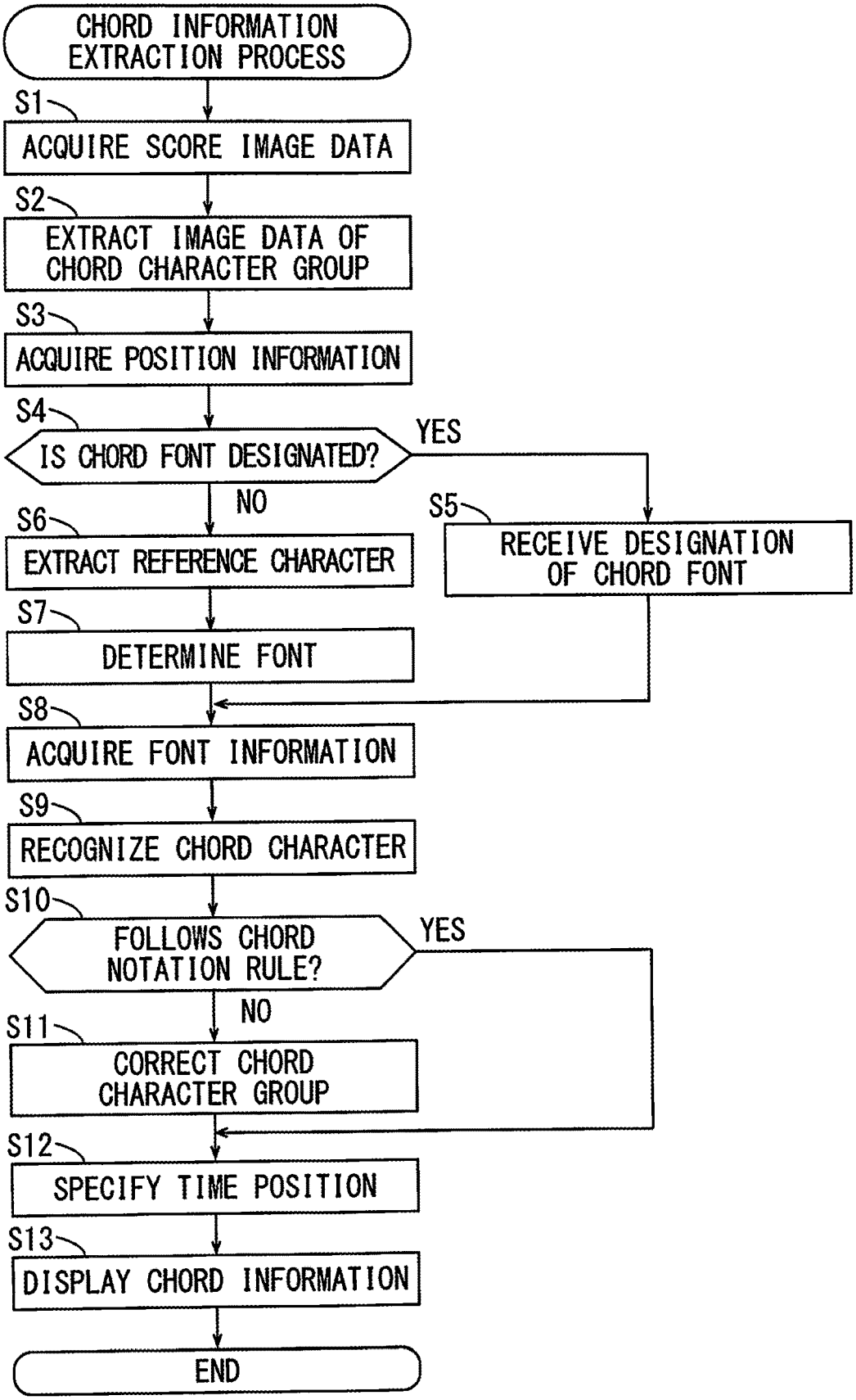
FIG. 10 is a flow chart showing one example of a chord information extraction process.

Next, the chord information extraction process using the chord information extraction method according to the present embodiment will be described. FIG. 10 is a flow chart showing one example of the chord information extraction process by each function of FIG. 2. The CPU 11 of FIG. 1 executes the chord information extraction program stored in the ROM 10 or the storage device 13 to perform the chord information extraction process of FIG. 10.

First, the image data acquirer 51 acquires the score image data input by the score inputter 1 (step S1). Next, the character group extractor 52 extracts the image data of one or a plurality of chord character groups from the acquired score image data (step S2). Next, the position information acquirer 58 acquires the position information of each chord character group from the acquired score image data (step S3).

Next, the font receiver 53 determines whether a chord font has been designated by the user (step S4). For example, in the font designation screen DA of FIG. 4, in a case where the analysis button AN is turned on with any of the option button OP2*a* or any of the option buttons OP3*a* being turned on, it is determined that the chord font is designated. In a case where the analysis button AN is turned on with the option button OP1 being turned on, it is determined that the chord font is not designated. In a case where the chord font is designated, the font receiver 53 receives the designation of the chord font (step S5) and proceeds to the step S8. In a case where the chord font is not designated, the font determiner 54 extracts reference characters from the score image data (step S6), determines the font of the extracted reference characters as a chord font (step S7) and proceeds to the step S8.

In the step S8, the font information acquirer 55 acquires the chord font received in the step S5 or the font information representing the chord font determined in the step S7 (step S8). Next, the character group extractor 52 recognizes each chord character of the acquired chord character group based on the acquired font information (step S9).

Next, the determiner 56 determines whether the recognized chord character group follows the chord notation rule CR (step S10). In a case where the recognized chord character group does not follow the chord notation rule CR, the recognized chord character group is corrected by the corrector 57 based on the correction table AT to follow the chord notation rule CR (step S11).

Next, the time position specifier 59 specifies the time position of each chord information piece in the reference music piece based on the position information acquired in the step S3 (step S12). Next, the display 6 is controlled by the display controller 60 to display the chord information represented by the corrected chord character group (step S13). Thus, the chord information extraction process ends.

[5] Effects of Embodiment

In the chord information extraction device 100 according to the above-mentioned embodiment, it is determined whether the chord character group extracted from the score image data follows the predetermined chord notation rule. In a case where not following the chord notation rule, the chord character group is corrected to follow the chord notation rule. Thus, even in a case where the chord character group is erroneously recognized, an appropriate chord character group that has been corrected to follow the chord notation rule can be acquired. Thus, the chord information can be accurately extracted from the score image data.

Further, in the above-mentioned embodiment, the extracted chord character group is divided into a chord root character group and a chord type character group. It is determined whether each of the chord root character group and the chord type character group are appropriate as the chord notation based on the predetermined chord root rule and chord type rule. Thus, the correctness determination of the chord character group can be carried out accurately.

Further, in the above-mentioned embodiment, the character, which does not follow the chord notation rule, among the extracted chord character group is corrected based on the predetermined correction table. Thus, the extracted chord character group can be corrected easily and appropriately.

Further, in the above-mentioned embodiment, each chord character of the chord character group is recognized based on the font information representing the font of the chord character group. Thus, each chord character is recognized with higher accuracy, so that the chord information can be extracted more accurately.

Further, in the above-mentioned embodiment, the time position of each chord information piece in the reference music piece is specified based on the position information of each chord character group in the music score. Thus, the extracted chord information can be displayed easily and efficiently, automatic accompaniment data can be generated easily and efficiently based on the extracted chord information, etc.

[6] Other Embodiments

While the extracted chord information is displayed on the screen of the display 6 in the above-mentioned embodiment, another process may be carried out using the extracted chord information. For example, automatic accompaniment data for outputting automatic accompaniment may be generated based on the extracted chord information and its time position.

While the chord information is extracted from the score image data representing the staff notation in the above-mentioned embodiment, the chord information may be extracted from the score image data, including the chord information, of the music score in another form. For example, a tab score, a chord score or the like may be used as a reference score, and chord information may be extracted from score image data representing these scores.

While the chord information extraction device 100 includes the score inputter 1 in the above-mentioned embodiment, the score inputter 1 may be used as an external device of the chord information extraction device 100.

The chord information extraction device 100 may be applied to an electronic musical instrument such as an electronic keyboard musical instrument, and may be applied to another electronic apparatus such as a personal computer, a smartphone or a tablet terminal.

A chord information extraction device may comprise: a memory configured to store processor-executable instructions; and a processor configured to execute the processor-executable instructions stored in the memory to thereby realize: a character group extractor configured to extract a character group corresponding to chord information from score image data representing a music score; a determiner configured to determine whether the extracted character group follows a chord notation rule; and a corrector configured to, in a case where the determiner determines that the extracted character group does not follow the chord notation rule, correct the extracted character group such that the corrected extracted character group follows the chord notation rule.

While preferred embodiments of the present invention have been described above, it is to be understood that variations and modifications will be apparent to those skilled in the art without departing the scope and spirit of the present invention. The scope of the present invention, therefore, is to be determined solely by the following claims.

I claim:

1. A chord information extraction device comprising:

a character group extractor configured to extract a character group corresponding to chord information from score image data representing a music score, the extracted character group including a plurality of characters;

a determiner configured to determine whether the extracted character group follows a chord notation rule by determining whether one or more of the plurality of characters included in the extracted character group match one or more of a known plurality of characters corresponding to known chord information;

a corrector configured to, in a case where the determiner determines that the extracted character group does not follow the chord notation rule based on a determination that the one or more of the plurality of characters included in the extracted character group do not match the one or more of the known plurality of characters corresponding to the known chord information, correct the extracted character group such that the one or more of the plurality of characters included in the corrected extracted character group follow the chord notation rule bar matching the one or more of the known plurality of characters corresponding to the known chord information.

2. The chord information extraction device according to claim 1, wherein the chord notation rule defines (i) a chord root rule in regard to a chord root and (ii) a chord type rule in regard to a chord type, and in a case where the extracted character group includes (iii) a chord root character group representing the chord root and (iv) a chord type character group representing the chord type, the determiner is configured to determine that the extracted character group follows the chord notation rule when the chord root character group follows the chord root rule and the chord type character group follows the chord type rule.

3. The chord information extraction device according to claim 1, wherein the corrector is configured to correct the extracted character group by correcting the one or more of the plurality of characters, which do not follow the chord notation rule, in the extracted character group based on a correction table.

4. The chord information extraction device according to claim 1, further comprising a font information acquirer configured to acquire font information representing a font of a character group corresponding to the chord information, wherein the character group extractor is configured to extract a character group corresponding to the chord information based on the acquired font information.

5. The chord information extraction device according to claim 4, further comprising a font receiver that is configured to receive designation of a font by a user, wherein the font information acquirer is configured to acquire the font information representing the designated font.

6. The chord information extraction device according to claim 4, further comprising a font determiner configured to extract at least one character from the score image data and determine a font of the extracted at least one character, wherein the font information acquirer is configured to acquire the font information representing the determined font.

7. The chord information extraction device according to claim 1, further comprising:

a position information acquirer configured to acquire position information representing a position of the extracted character group in the music score; and a time position specifier configured to specify a time position in a music piece represented by the music score based on the acquired position information.

8. The chord information extraction device according to claim 7, wherein the time position specifier is configured to specify a time position of the chord information corresponding to the extracted character group in the music piece.

9. A chord information extraction method comprising:

extracting a character group corresponding to chord information from score image data representing a music score, the extracted character group including a plurality of characters;

determining whether the extracted character group follows a chord notation rule by determining whether one or more of the plurality of characters included in the extracted character group match one or more of a known plurality of characters corresponding to known chord information; and correcting, in a case where it is determined that the extracted character group does not follow the chord notation rule based on a determination that the one or more of the plurality of characters included in the extracted character group do not match the one or more of the known plurality of characters corresponding to the known chord information, the extracted character group such that the one or more of the plurality of characters included in the corrected extracted character group follow the chord notation rule by matching the one or more of the known plurality of characters corresponding to the known chord information.

10. The chord information extraction method according to claim 9, wherein the chord notation rule defines (i) a chord root rule in regard to a chord root and (ii) a chord type rule in regard to a chord type, and the determining includes determining, in a case where the extracted character group includes (iii) a chord root character group representing the chord root and (iv) a chord type character group representing the chord type, that the extracted character group follows the chord notation rule when the chord root character group follows the chord root rule and the chord type character group follows the chord type rule.

11. The chord information extraction method according to claim 9, wherein the correcting the extracted character group includes correcting the one or more of the plurality of characters, which do not follow the chord notation rule, in the extracted character group based on a correction table.

12. The chord information extraction method according to claim 9, further comprising acquiring font information representing a font of a character group corresponding to the chord information, wherein the extracting the character group includes extracting the character group corresponding to the chord information based on the acquired font information.

13. The chord information extraction method according to claim 12, further comprising receiving designation of a font by a user, wherein the acquiring the font information includes acquiring the font information representing the designated font.

14. The chord information extraction method according to claim 12, further comprising extracting at least one character from the score image data and determining a font of the extracted at least one character, wherein the acquiring the font information includes acquiring the font information representing the determined font.

15. The chord information extraction method according to claim 9, further comprising:

acquiring position information representing a position of the extracted character group in the music score; and specifying a time position in a music piece represented by the music score based on the acquired position information.

16. The chord information extraction method according to claim 15, wherein the specifying the time position includes specifying a time position of the chord information corresponding to the extracted character group in the music piece.

17. A chord information extraction device comprising:

a character group extractor configured to extract a character group corresponding to chord information from score image data representing a music score;

a determiner configured to determine whether the extracted character group follows a chord notation rule; and a corrector configured to, in a case where the determiner determines that the extracted character group does not follow the chord notation rule, correct the extracted character group to a character group that follows the chord notation rule, wherein the chord notation rule defines (i) a chord root rule in regard to a chord root and (ii) a chord type rule in regard to a chord type, the chord root rule defines a plurality of chord root character groups that represent a plurality of chord roots, and the chord type rule defines a plurality of chord type character groups that represent a plurality of chord types, and the determiner is configured to determine that the extracted character group follows the chord notation rule when the extracted character group includes (iii) any one of the plurality of chord root character groups defined by the chord root rule and (iv) any one of the plurality of chord type character groups defined by the chord type rule.

18. A chord information extraction device comprising:

a character group extractor configured to extract a character group corresponding to chord information from score image data representing a music score;

a determiner configured to determine whether the extracted character group follows a chord notation rule;

a corrector configured to, in a case where the determiner determines that the extracted character group does not follow the chord notation rule, correct the extracted character group to a character group that follows the chord notation rule;

a position information acquirer configured to acquire position information representing a position of the extracted character group in the music score; and a time position specifier configured to specify a time position in a music piece represented by the music score based on the acquired position information, wherein the chord notation rule defines (i) a chord root rule in regard to a chord root and (ii) a chord type rule in regard to a chord type, and the chord root rule defines a plurality of chord root character groups that represent a plurality of chord roots, and the chord type rule defines a plurality of chord type character groups that represent a plurality of chord types.

* * * * *